United States Patent [19]

Capitani

[11] Patent Number: 4,828,139

[45] Date of Patent: May 9, 1989

[54] PACKAGE COMPRISING A BODY INCORPORATING AT LEAST ONE OPENING AND A LID CAPABLE OF BEING FASTENED ONTO THE OPENING BY A TAIL PIECE

[75] Inventor: Gilles Capitani, Conflans-Ste-Honorine, France

[73] Assignee: Societe Bourguignone d'Applications Plastique, Paris, France

[21] Appl. No.: 208,431

[22] Filed: Jun. 20, 1988

[30] Foreign Application Priority Data

Jun. 19, 1987 [FR] France ..... 87 08693

[51] Int. Cl.[4] ..... B65D 45/34

[52] U.S. Cl. ..... 220/316; 220/319; 220/320

[58] Field of Search ..... 220/316, 319, 320, 321; 292/256.65

[56] References Cited

U.S. PATENT DOCUMENTS 4,442,951 4/1984 Nakazawa et al. ..... 220/319
4,711,366 12/1987 Chen ..... 220/316

FOREIGN PATENT DOCUMENTS 3301335 2/1984 Fed. Rep. of Germany .
992436 10/1951 France .
234075 12/1944 Switzerland .

*Primary Examiner*—George T. Hall
*Attorney, Agent, or Firm*—Spencer & Frank

[57] ABSTRACT

The mechanism (10) for controlling the tail piece (13) is arranged within the surface area bounded by a clamping collar 9 equipped with the tail piece (13) so that the control of the tail piece (13) is performed by a pivoting motion of the lever (11) controlling the tail piece above the surface of the lid (2).

1 Claim, 3 Drawing Sheets

PACKAGE COMPRISING A BODY INCORPORATING AT LEAST ONE OPENING AND A LID CAPABLE OF BEING FASTENED ONTO THE OPENING BY A TAIL PIECE

The present invention relates to a package comprising a body of overall cylindrical shape incorporating at least one circular opening with a diameter at least equal to one half of the longest dimension of a cross-section of the body and at least one lid capable of being fastened onto the opening by means of a tail piece.

There are already known packages such as drums, boxes and cases for ammunition, and the like, in which the retention of the closure lid(s) is provided by a clamping collar controlled by a tail piece, that is to say by an eccentric lever whose pivoting permits the opening and the closure of the package, owing to an increase and a decrease in the perimeter of the clamping collar, respectively.

In general, in a closure of this type, the control for opening and closing the tail piece is arranged so that the control lever performs its pivoting motions towards the outside of the lid and, consequently, when it is employed for packages which, to permit them to be stored and handled, are grouped side by side on pallets, for example by means of strapping, it is not possible to open one or more packages without withdrawing them from the assembly because the neighbouring packages interfere with any pivoting of the lever controlling the tail piece for the purpose of releasing the lids.

The objective of the present invention is to provide a package which does not have the abovementioned disadvantage.

Accordingly, the invention relates to a package comprising a body of overall cylindrical shape incorporating at least one circular opening with a diameter at least equal to one half of the longest dimension of a cross-section of the body and at least one lid capable of being fastened onto the opening by means of a tail piece in which the mechanism for controlling the tail piece is arranged within the surface area bounded by a clamping collar, so that the control of the tail piece is performed by a pivoting of the control lever above the surface of the lid.

The body of the package according to the invention may be made of any material such as cardboard, metals, plastics and the like.

An overall cylindrical shape means a body of elongate shape whose cross-sections perpendicular to the lengthwise axis are circular or polygonal, it being possible for the cross-sections to vary along this axis.

In the region of each opening of generally circular cross-section, the body of the package must have a rim permitting the engagement of the clamping collar equipped with the tail piece when the lid is fitted.

The lid, of overall circular shape and adapted to the diameter of the opening to be closed, may also be made of any material and, generally, of a material similar to that forming the body of the package. The lid must also have a rim permitting the engagement of the clamping collar equipped with the tail piece in order to ensure an effective mating of the lid with the opening to be shut off when the tail piece is closed.

The clamping collar generally consists of a profiled metal strip which is shaped so as to form an open circle, the ends of the strip being connected by the tail piece, that is to say by an eccentric control incorporating a control lever which, by its pivoting motions, causes the ends of the shaped metal strip to come together or to move apart.

In accordance with the invention, the mechanism controlling the tail piece, in contrast to the usual practice, is arranged within the surface area bounded by the tail piece, and by the profiled metal strip, the pivoting motions of the control lever for opening or closing the tail piece being performed above the lid surface and parallel to the latter. In general, the distance between the lid and the lever controlling the tail piece is from 10 to 50 mm.

According to a practical embodiment of the invention which is found particularly advantageous during the production of large-capacity packages equipped with lids provided with a removable degassing valve permitting the interior of the package to be placed at atmospheric pressure as a safety measure before it is opened, the removable degassing valve is arranged on the beginning of the trajectory for opening the lever controlling the tail piece so as to prevent any opening of the lid before the degassing valve is extracted. This eliminates any risk of accident due to the lid being thrown forth as the tail piece is opened, when the pressure prevailing within the package is higher than atmospheric pressure, since it becomes essential to withdraw the degassing valve from the lid in order to make it possible to pivot the lever controlling the tail piece.

Furthermore, the package in accordance with the invention is further clarified in detail in the description which is to follow and which refers to a package capable of being employed for the protection, storage and transport of missiles.

In this description, reference is made to the Figures in the attached drawings, in which.

Figure 1:
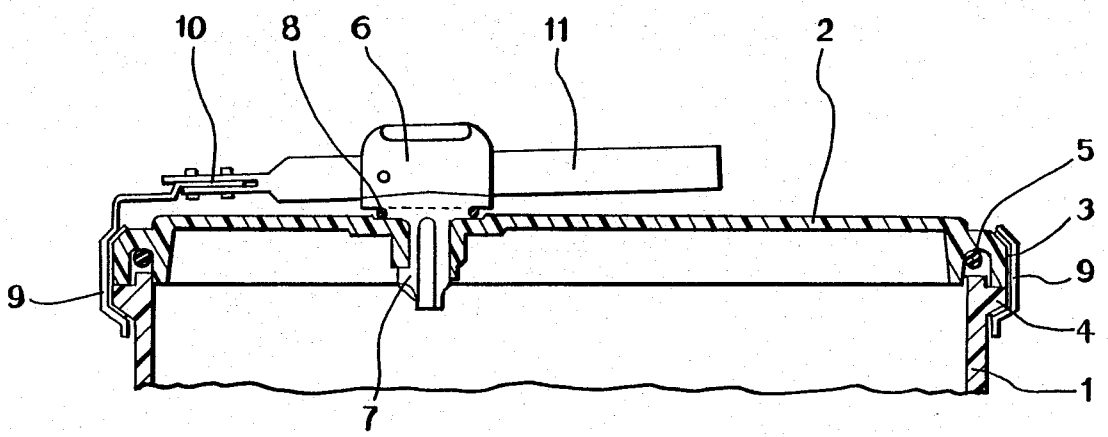
FIG. 1 is a partial and sectional view of the package.

As shown in FIG. 1, the package consists of a body 1, part of which is illustrated, of elongate polygonal cross-section which is produced by the blow-moulding method, the material of construction being high density polyethylene.

The large-diameter opening in the body of the package is provided with a lid 2, which is also injection-moulded using high density polyethylene, whose rim 3 bears on a rim 4 provided on the opening in the package body 1, a seal 5 being arranged between the lid 2 and the opening in the body 1.

Moreover, the lid 2 is equipped with a removable degassing valve 6 which is immobilized in a closed position by a locking stud 7, the sealing being provided by a seal 8.

Figure 2:
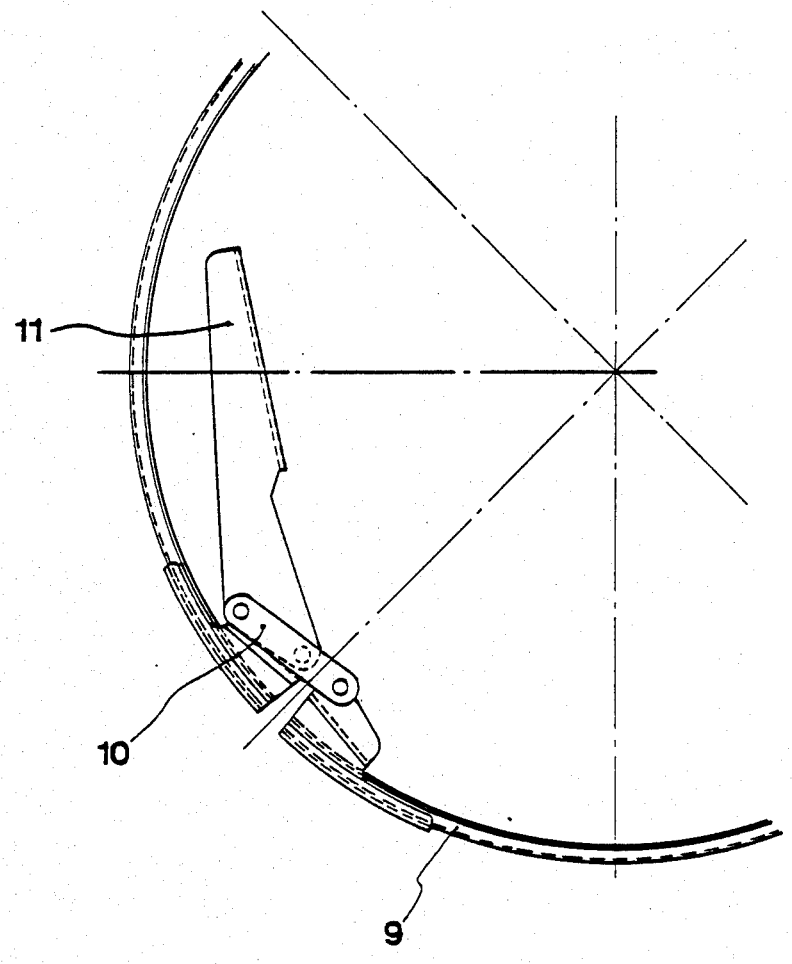
FIG. 2 is a detailed view of the tail piece employed for the package according to FIG. 1.

In accordance with the invention, the locking of the lid 2 onto the package body 1 is provided by a clamping collar 9 and by a tail piece 13, shown in greater detail in FIG. 2, whose eccentric control mechanism 10 is arranged above the lid 2 and towards the interior of the clamping collar 9 so that the control of the tail piece is performed by a pivoting motion of the control lever 11 above the surface of the lid 2.

Figure 3:
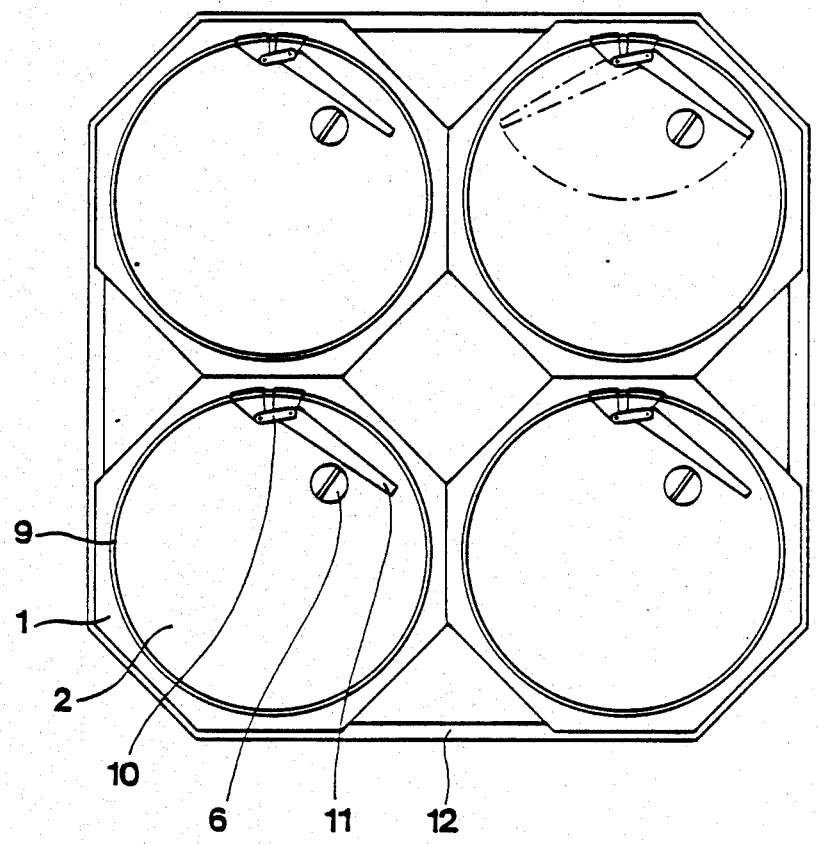
FIG. 3 is a profile view showing four packages according to FIG. 1 stacked lengthwise and held by a strapping.

Furthermore, as is shown better in FIG. 3, the degassing valve with which the lid 2 is equipped is arranged on the beginning of the trajectory for opening the lever 11 controlling the tail piece 13 so as to prevent any opening of the lid due to a release of the tail piece 13 before withdrawal of the removable degassing valve 6.

In this way, there is no risk of any operator being wounded as a result of the lid 2 being thrown forth in the event where, for example because of weather conditions, the interior of the package could be at a pressure markedly higher than the atmospheric pressure.

Lastly, as can be seen in FIG. 3, showing four packages 1 stacked lengthwise and held by a strapping 12, it is possible to open each package 1 in succession and to withdraw the packaged missile therefrom, without having to remove the packages from the stack.

I claim:

1. Package comprising a body of overall cylindrical shape incorporating at least one circular opening with a diameter at least equal to one half of the longest dimension of a cross-section of the body and at least one lid capable of being fastened onto the opening by means of a clamping collar controlled by a tail piece having a control lever disposed inside the area delimited by the clamping collar and the tail piece so that the control of the tail piece is performed by a pivoting of a control lever above the surface of the lid and in which the lid is equipped with a removable degassing valve characterized in that the degassing valve is arranged on the beginning of the opening trajectory of the lever controlling the tail piece and prevents any opening of the lid before the extraction of the removable degassing valve.

* * * * *